US005201443A

United States Patent [19]

Oswald

[11] Patent Number: 5,201,443

[45] Date of Patent: Apr. 13, 1993

[54] GARMENT HANGER AND TOY COMBINATION

[76] Inventor: Walter A. Oswald, 13544 Crestview Drive, Surrey, Canada, V3R 6T2

[21] Appl. No.: 680,369

[22] Filed: Apr. 4, 1991

[51] Int. Cl.[5] ..... A47G 25/14; A47G 25/40

[52] U.S. Cl. ..... 223/85; 223/DIG. 4; 223/94; 446/73; 446/330; D6/315

[58] Field of Search ..... 223/89, 94, DIG. 4, 223/85, 92; 446/73, 330; 211/113; D6/315

[56] References Cited

U.S. PATENT DOCUMENTS

| | | | |
|---|---|---|---|
| D. 60,514 | 3/1922 | Denivelle . | |
| D. 123,389 | 11/1940 | Dunlap . | |
| D. 123,392 | 11/1940 | Dunlap . | |
| D. 123,396 | 11/1940 | Dunlap . | |
| D. 197,448 | 2/1964 | Broak . | |
| D. 205,256 | 7/1966 | Poland . | |
| 1,096,018 | 5/1914 | Buchwald . | |
| 3,205,614 | 9/1965 | Brosk . | |
| 3,475,852 | 11/1969 | Brosk | 446/73 |
| 3,700,384 | 10/1972 | Gardel et al. | 446/330 X |
| 4,063,670 | 12/1977 | Faarbech | 223/92 |
| 4,563,373 | 1/1986 | Barnett | 223/85 |
| 4,601,671 | 7/1986 | DeMars | 446/330 |
| 4,615,447 | 10/1986 | Walter | 211/4 |
| 4,951,484 | 8/1990 | Rohald et al. | 223/85 X |

FOREIGN PATENT DOCUMENTS

| | | | |
|---|---|---|---|
| 2616143 | 10/1977 | Fed. Rep. of Germany | 223/94 |
| 1299182 | 7/1960 | France | 223/94 |
| 7700446 | 8/1978 | France | 446/73 |
| 170349 | 2/1960 | Sweden | 223/DIG. 4 |
| 250620 | 9/1947 | Switzerland | 223/94 |
| 472204 | 6/1969 | Switzerland | 223/DIG. 4 |
| 2127284 | 4/1984 | United Kingdom | 223/85 |

*Primary Examiner*—Werner H. Schroeder
*Assistant Examiner*—Bibhu Mohanty
*Attorney, Agent, or Firm*—Bull, Housser & Tupper

[57] ABSTRACT

A garment hanger and toy combination comprises a head and body disposed along a longitudinal axis and limbs extending outwardly from the body transversely of the axis. Support means are provided for hanging the combination and the support means is is extendible outwardly from a recess within a top portion of the head when the combination is to be used as a garment hanger, and is retractable into the recess when the combination is to be used as a toy. Movement of the support means is along the axis and is limited to axial movement only, with negligible rotational movement. Preferably, the support means is subjected to an outwardly directed resilient force, and the support means can be latched with a latch structure against the outwardly directed force to hold the support means retracted. The latch structure can be released by direct application of a force to a lower portion of the body, or alternatively can be released by bending the limb sufficiently to release the latch.

18 Claims, 5 Drawing Sheets

GARMENT HANGER AND TOY COMBINATION

BACKGROUND OF THE INVENTION

The invention relates to a garment hanger, particularly adapted for supporting children's clothing, and being encased within a decorative soft toy animal body it can also serve as a toy.

It is known to provide a clothes hanger which simulates at least a portion of an animal, typical examples being shown in U.S. Design Pat. Nos. 123,389; 123,392 and 123,396, all being issued to M. B. Dunlap. These designs represent animal's heads and front limbs and appear to be fabricated from a flat sheet of material, and can be provided with a hook for hanging. U.S. Design Pat. No. 60,514 issued to Denivelle, U.S. Design Pat. No. 197,448 issued to Broak, and U.S. Pat. No. 3,205,614 issued to Brosk, disclose a human form or portion of a human form with shoulders to hang clothing thereon. Denivelle has a sculptured form, but the remaining two devices appear to be fabricated from a thin sheet of stiff material. Each of these designs discloses a hook extending rigidly from the head of the human form for hanging the item.

U.S. Pat. No. 4,615,447, in which the inventor is Walter, discloses a security garment display stand which provides a complex mechanism to prevent unauthorized removal of garments from a display stand. The hanger has a axially retractable hook which retracts into the body of the hanger. U.S. Pat. No. 4,063,670 issued to Faarbech also discloses a hanger with a retractable hook device, the hook being swingable about a pin passing through a slot in the body of the hook, permitting the hook to move from an obliquely retracted position to an axially extended position to facilitate storage.

None of the garment hanging devices known to the present inventor provides a garment hanger which resembles a soft toy to encourage the child to hang his garments at the end of the day, and which can also be used as a soft toy when not supporting garments.

SUMMARY OF THE INVENTION

The invention reduces the difficulties and disadvantages of the prior art by providing a garment hanger and toy combination which has at least a portion of an animal's body, head and at least one pair of limbs to receive the garment, and which is three-dimensional and soft so as to closely resemble a stuffed soft toy animal. Furthermore, because the device is pleasing to the eye and safe to use as a stuffed toy animal, it can assist in training children to be tidy with their clothing.

A garment hanger and toy combination according to the invention comprises a head and a body disposed about a longitudinal axis, and a pair of limbs extending outwardly from the body generally transversely of the axis. The head has a top portion and a recess within the top portion disposed adjacent the axis. The limbs are cantilevered from the body to support load thereon when the body is hanging. The combination further comprises a support means for hanging the combination, the support means being extendable outwardly from the recess within the head, and retractable into the recess, movement of the support means being along the axis. Preferably, limiting means are provided to limit movement of the support means relative to the recess to axial movement only, with negligible rotational movement. Preferably, resilient means cooperate with the support means and apply an outwardly directed force to the support means. Latch means latch the support means against the outwardly directed force and cooperate with support means and the body.

A detailed disclosure following, related to the drawings, describes a preferred embodiment of the invention which is capable of expression in structure other than that particularly described and illustrated.

DESCRIPTION OF THE DRAWINGS

Some sizes and clearances are exagerated for clarity in several figures.

DETAILED DISCLOSURE

FIG. 1

Figure 1:
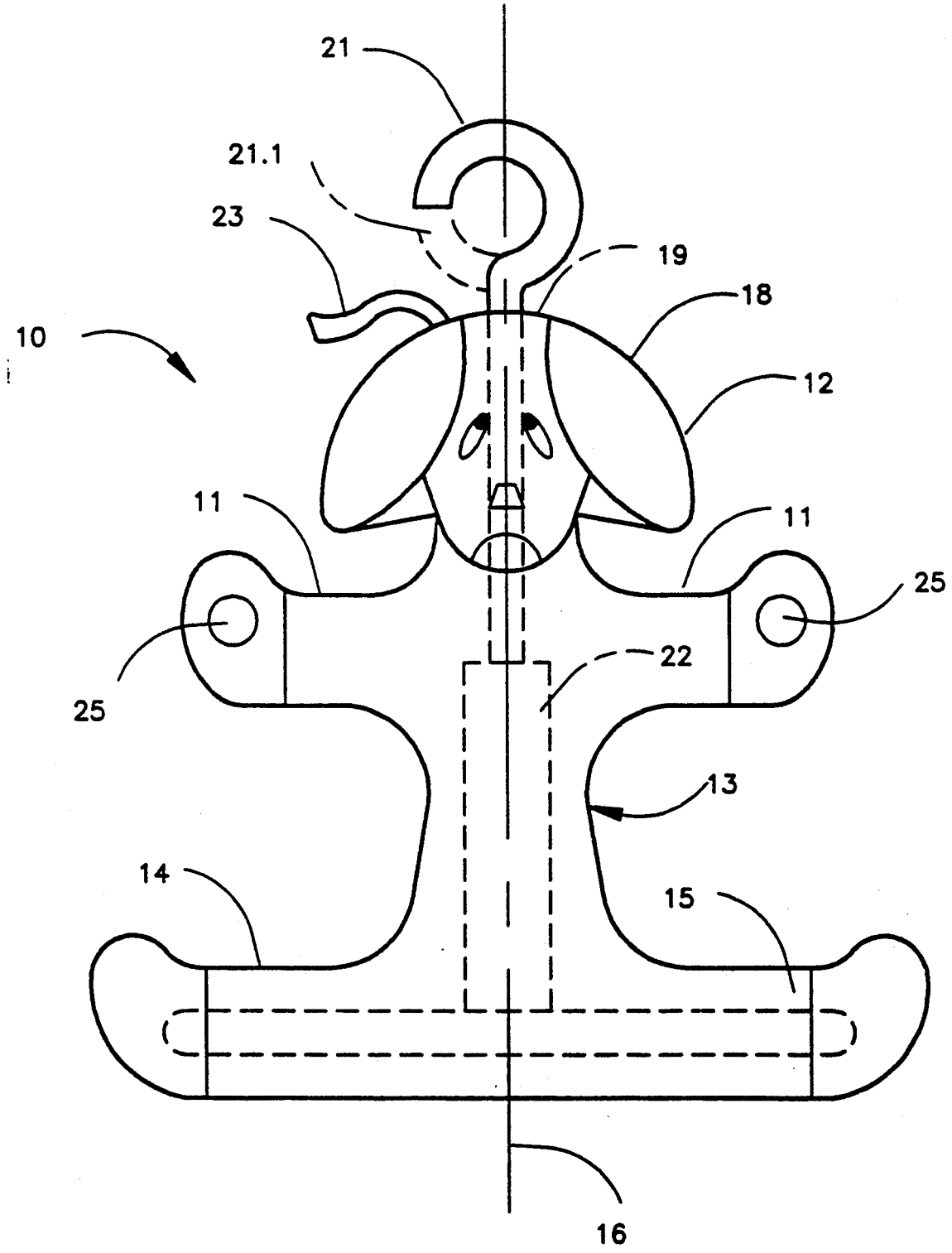
FIG. 1 is a simplified front elevation of the invention, showing one embodiment portrayed as a dog, a retractable hook of a support means being shown in broken outline in an extended position, some hidden internal details being shown simplified in broken outline.

A garment hanger and toy combination 10 according to the invention has an animal shape with a head 12 and body 13 disposed about a longitudinal axis 16. The combination also comprises two pairs of limbs, in this instance, front legs 11 and right and left rear legs 14 and 15 respectively, extending outwardly from the body generally transversely of the axis. The head, body and limbs are covered with a simulated fur material which is stuffed with a resilient padding material to protect the internal structure and to resemble a soft children's toy.

The head has a top portion 18 with a recess 19 therein disposed adjacent the axis. A hook 21, or alternatively a closed ring or eye as shown in broken line at 21.1, can extend outwardly from the recess as shown in broken outline to serve as a support means to hang the combination when used as a garment hanger When used as a toy, the hook of the support means is retracted into the recess, movement of the support means being along the axis 16 and guided by internal structure 22, broken outline, as will be described. A retaining flap 23 of simulated fur material is secured adjacent one side of the recess 19, and has a size sufficient to extend across the recess to an opposite side of the recess. The flap can be secured to the opposite side with soft, releasable fastening means, e.g. nylon hook tape, such as "Velcro", a registered trade-mark. The flap is used to retain the hook 21 within the recess when in the retracted position so that the hook interferes minimally with normal playing with the toy.

Preferably, the front legs are fabricated from fabric tubes which are stuffed to provide shape, are bendable, and have outer ends with complementary releasable fastening means 25, such as "Velcro", to permit the ends of the legs to grip each other to from a loop to support a scarf or other small item of clothing.

FIGS. 2 through 5

The internal structure 22 of the body 14 comprises a straight inner tube 30 disposed along the longitudinal axis 16 and extending from adjacent the recess 19 in the head, not shown, to a lower portion of the body adjacent the legs 14 and 15. Right and left limb stiffening means 33 and 34 made from steel wire extend transversely from a lower portion of the tube 30 in opposite directions to provide support for the rear legs as will be described. As previously stated, the front legs 11 are bendable and do not require separate stiffening means.

The hook 21 is a portion of a support means 36 for hanging the combination, and includes an outer portion 37 to provide the hook, and an inner portion 38 slidable within the tube 30. The inner portion 38 is a straight rod which is mounted for axial movement within the tube 30. The tube 30 thus serves as a guide means for guiding movement of the support means axially of the body and the head portions between retracted and extended positions of the support means. The inner portion 38 of the means 36 extends downwardly from a first shoulder 41 to an inner end 43 and preferably has a generally square cross-section, or at least one flat side face or other guide structure. The outer portion 37 is preferably of circular cross-section which is smaller than the square cross-section of the inner portion 38, and thus the shoulder 41 is provided at the junction between the inner portion 38 of larger square cross-section and the outer portion 37 of smaller circular cross-section. The tube 30 is partially flattened to provide at least one flat portion adjacent the inner end 38, the flat portion positioned to be generally complementary to the flat face of the inner portion of the rod. Alternatively, the tube 30 has a portion with a square cross-section which is complementary to the cross-section of the inner portion 38. Thus, the complementary square cross-sections of the inner portion 38 and the tubes serve as limiting means to limit movement of the support means relative to the recess to axial movement only, with negligible rotational movement. Also the inner portion 38 of the support means has a slot 45 therein to provide a second shoulder 47 for purposes to be described.

A lower end 49 of the tube 30 has a pin 51 extending thereacross to provide an end stop for a compression coil spring 53 which extends between the pin 51 and the inner end 43 of the support means 36, and thus cooperates with the support means to apply an outwardly or upwardly directly axial force thereto. Clearly, other resilient means cooperating with the support means can similarly be substituted.

FIGS. 2, and 4 through 8

Figure 4:
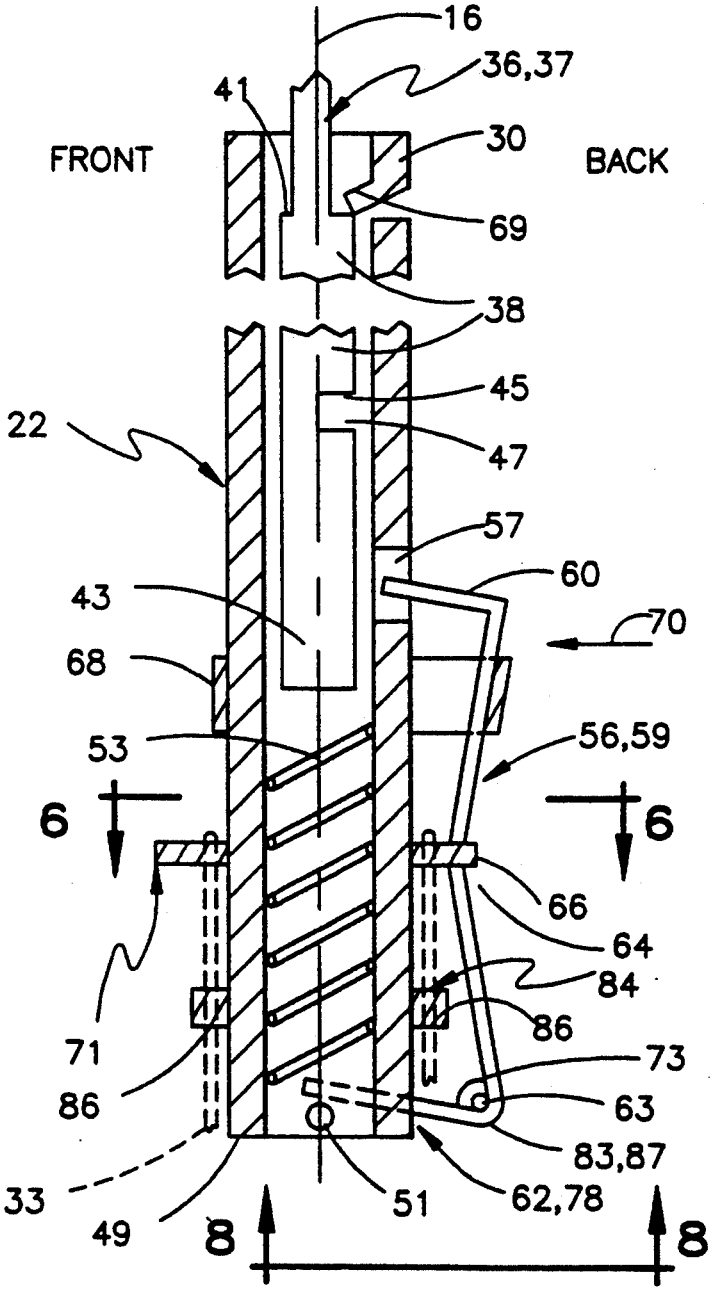
FIG. 4 is a simplified, fragmented section on Line 4—4 of FIG. 2 showing a lower portion of the apparatus, with a latching means thereof disengaged from a support means to permit the support means to attain an extended position, some portions being removed for clarity.
Figure 5:
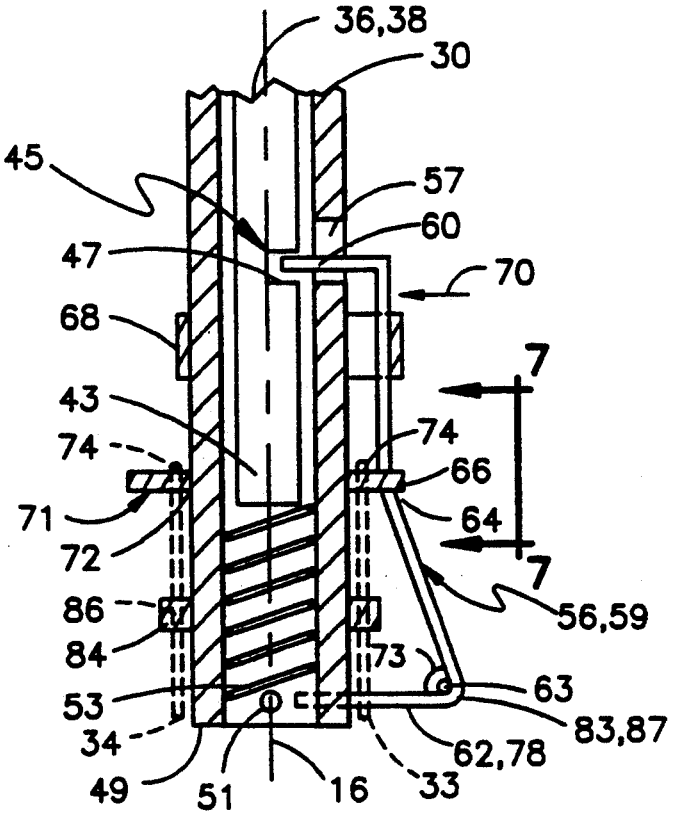
FIG. 5 is a view similar to FIG. 4 showing the latching means engaged to prevent extension of the support means so as to hold the support means in a retracted position.

Referring to FIGS. 4 and 5, a latch means 56 is located on the animal's lower back and is used for latching the support means against the outwardly directed force from the spring 53 and cooperates with the support means and the body means as follows. The tube 30 has a clearance opening 57 which is located axially and circumferentially so as to be aligned with the slot 45 when the support means 36 is fully retracted. The latch means 56 comprises a rocker arm 59 having an engaging portion 60 at one end, a release portion 62 at an opposite end, and an intermediate portion 64 disposed between the two ends. The release Portion 62 also has a trigger opening 63 to receive a trigger means as will be described. The intermediate portion 64 has a shallow V-shape, and is located with respect to the tube 30 by a pivot means 66 which engages a vertex portion of the intermediate portion which is closest to the tubes and is described in greater detail in FIGS. 6 and 7. A rubber band 68 or an equivalent resilient loop extends around the tube 30 and around a portion of the latch means adjacent the engaging portion 60, so as to draw the engaging portion in direction of an arrow 70. The slot 45 has a size to receive the engaging portion 60 of the latch means as will be described.

Referring to FIG. 4, the release portion 62 has been depressed so that the engaging portion 60 is disengaged from the slot 45 and adjacent the opening 57. This permits the support means to extend outwardly under force from the spring 53 to attain the extended position. A stop means 69 extends inwardly from the tube 30 to engage the first shoulder 41, thus limiting outwards movement of the support means due to the spring 53.

Referring to FIG. 5, when the inner portion 38 of the support means is fully retracted, so as to compress the spring 53, the slot 45 is aligned with the opening 57 within the tube 30. Thus, force from the band 68 moves the engaging portion 60 into engagement with the shoulder 47 of the slot 45, so as to prevent outwards movement of the support means under the influence of the outwardly directed force from the spring. It can be seen that the tube 30 has a side wall having the clearance opening 57 adjacent the latch means 56. The clearance opening is located to receive the engaging portion 60 of the latch means 56 to permit engagement with the second shoulder 47 to prevent extension of the support means.

Figure 6:
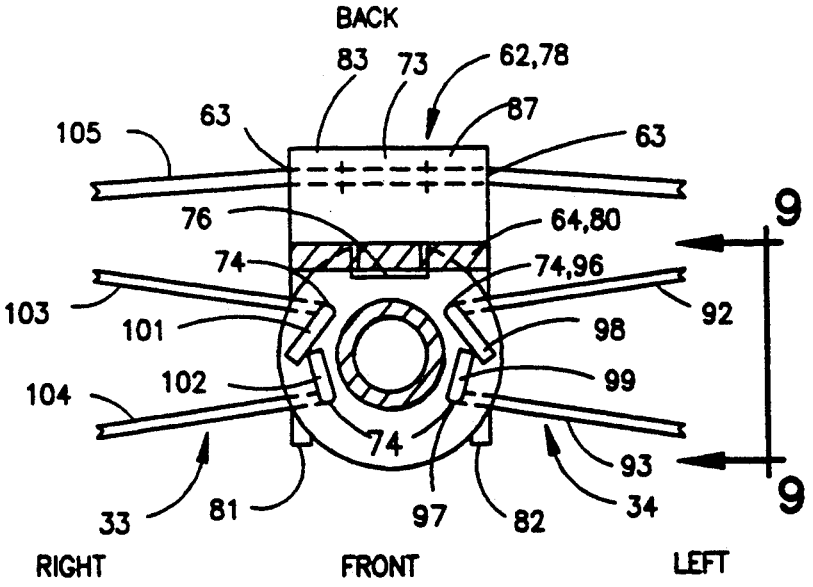
FIG. 6 is a simplified, fragmented, transverse section of a portion of the latching means and limb stiffeners, as shown from line 6—6 of FIG. 4.
Figure 7:
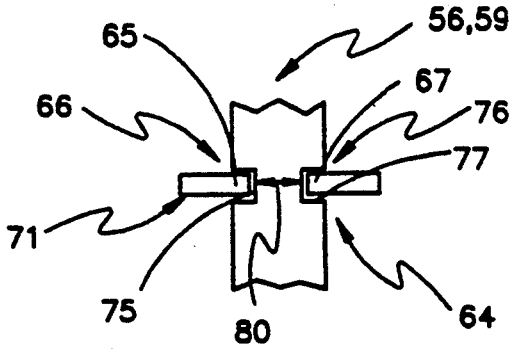
FIG. 7 is a simplified, fragmented, view of a portion of the latching means as seen from line 7—7 of FIG. 5.

Referring to FIGS. 6 and 7, the pivot means 66 comprises a generally annular disc or washer 71 having a central opening 72 which is a snug fit on the tube 30. The disc 71 has four peripheral openings 74 disposed adjacent corners of a rectangle inscribed within the washer to receive portions of wire to provide pivots for the wire of the limb means as will be described. The washer 71 has a periphery having a rectangular main recess 76 which has a width defined by peripherally spaced shoulders 65 and 67 and a depth sufficient to receive the intermediate portion 64 of the rocker arm therein. The portion 64 has a pair of oppositely located edge recesses 75 and 77 which provide a waisted portion 80 which has a width slightly smaller than width of the main recess 76 to be received therein. The recesses 75 and 77 have a width slightly larger than thickness of the washer 71 to receive the shoulders 65 and 67 therein, and thus locate the rocker arm on the pivot means and restrict axial movement therebetween while providing a pivotting action.

Figure 8:
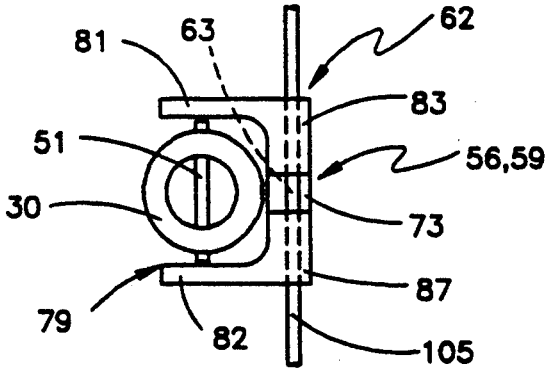
FIG. 8 is a simplified fragmented view of an outer portion of the latching means showing guiding means thereof, as seen from lines 8—8 of FIG. 4.

Referring to FIG. 5, 6 and 8, the release portion 62 has a slitted plate portion 78 at an end thereof, the portion 78 having two slits which provide three portions, namely two outer portions 83 and 87, and an inner portion 73. The inner portion 73 is displaced inwardly from the outer portions to provide a trigger opening 63 between the portions 73, 83 and 87 to receive a portion of wire, as will be described. The portion 78 has an end recess 79 which has a size sufficient to receive the tube 30 therein as a snug fit. The recess 79 is partially defined by a pair of generally parallel arms 81 and 82 which are spaced apart sufficiently to embrace the tube 30 at a position inboard of the pin 51. The cooperation between the recesses 75 and 77 and the washer 71, and the arms 81 and 82 of the portion 62 and the tube 30, serve as means to restrict the rocker arm against axial movement along the tube, and also against lateral twisting with respect to the tube.

Referring again to FIGS. 4 and 5, an anchor means 84 has an opening to closely enclose the tube 30 and is disposed outwardly of the washer 71, i.e. downwardly along the tube. The anchor means 84 also has four peripheral openings 86, two only being shown in FIGS. 4 and 5. The four peripheral openings 86 of the anchor means 84 are axially aligned with the four peripheral opening 74 of the washer 71 (FIG. 6), and are similarly adapted to receive the wire portions of the limb stiffening means 33 and 34 as follows. The limb stiffening means are essentially similar, and thus only the left limb stiffening means 34 will be described as follows.

FIGS. 2 and 3, and 6 through 10

Figure 2:
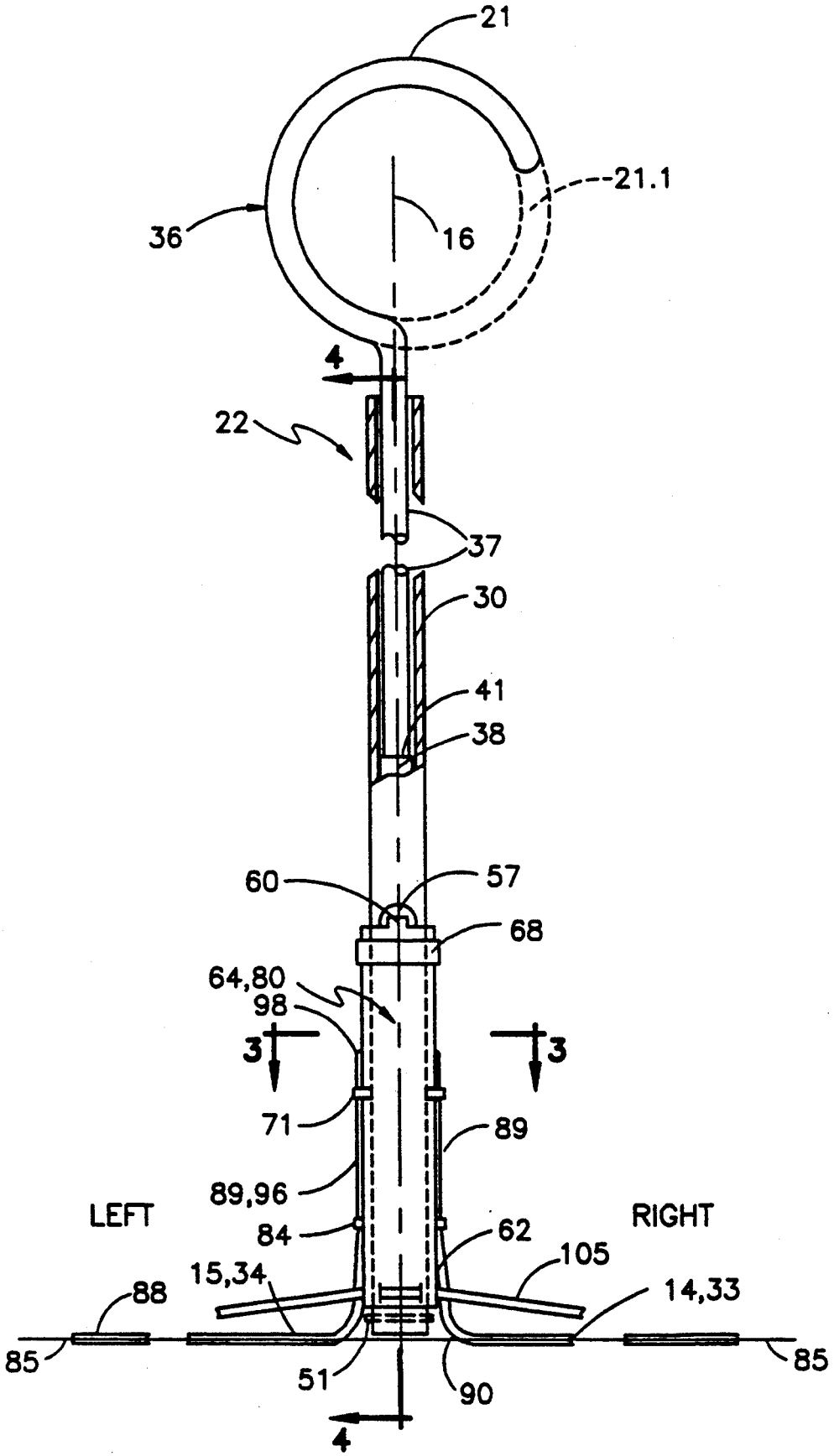
FIG. 2 is a fragmented, simplified, partially sectioned, rear elevation of the invention, some internal details being omitted.
Figure 3:
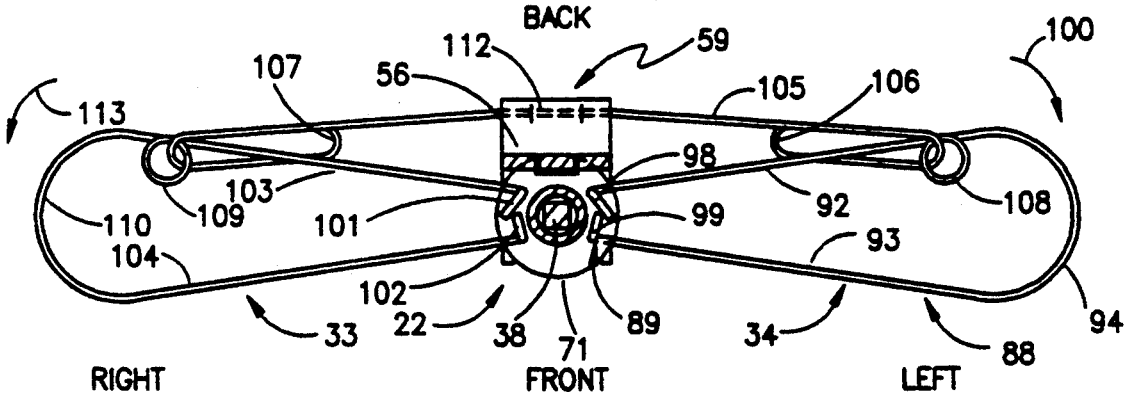
FIG. 3 is a simplified, partial section on Line 3—3 of FIG. 2 showing a pair of limb stiffeners aligned.
Figure 10:
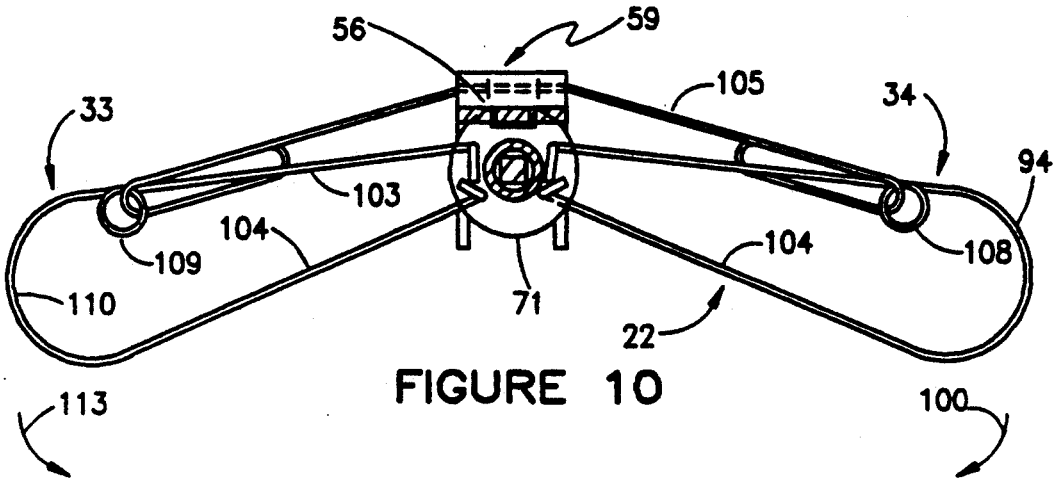
FIG. 10 is a plan similar to FIG. 3, showing the limb stiffeners deflected.

Referring to FIGS. 2 and 3, the left limb stiffening means 34 is formed from a loop of stiff wire to provide a distal portion 88, a proximal portion 89 and an intermediate bend portion 90 disposed between the distal and proximal portions. The distal portion 88 has a pair of outwardly diverging essentially straight side portions 92 and 93 interconnected by an outer bend portion 94. The side portions 92 and 93 are generally within a plane 85 (FIG. 2) normal to the axis 16 and converge inwardly towards the intermediate bend portion 90.

Figure 9:
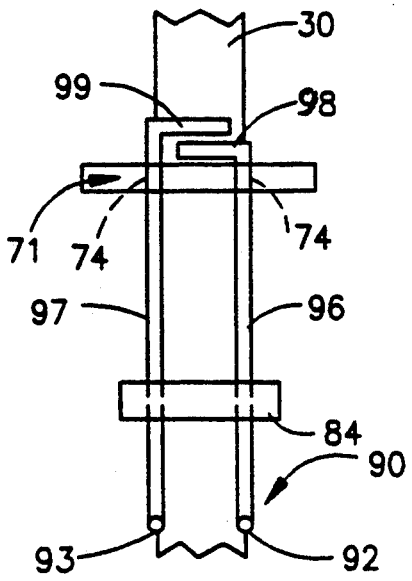
FIG. 9 is an enlarged simplified detail view of proximal portion of limb stiffeners, as seen from line 9—9 of FIG. 6.

Referring to FIGS. 2, 6 and 9, at the intermediate bend portion 90, each side portion is smoothly curved through a right angle through relatively large radii, and the wire portions then extend generally parallel along the tube as two straight inner portions 96 and 97 respectively. The end portions 96 and 97 pass through two adjacent aligned openings in the anchor means 84 and the washer 71 which permit rotation therein but also restrain the proximal portion 89 laterally adjacent the tube 30. As seen in FIGS. 6 and 9, the inner portions 96 and 97 have short angled end portions 98 and 99 respectively which are at right angles to the portions 96 and 97 and are inclined towards the tube, and can be rotated slightly to provide a restraint to the inner portions The right limb stiffening means 33 is generally similar and thus is not described in detail except as follows. As seen in FIG. 6, the right stiffening means 33 has short angled end portions 101 and 102 at upper ends of wire side portions 103 and 104, which are equivalent to the end portions 98 and 99 of the left stiffening means 34 and are provided on an opposite side of the tube 30 and in a similar manner provide a resilient connection therewith as follows.

The inner portions 96 and 97 of the wires forming the distal portion 88 of the left limb stiffening means 34 pass through the aligned openings in the washer 71 and anchor means 84, and are restricted against axial movement by the end portions 98 and 99 at one end thereof, and the intermediate bend portions 90 and at opposite end thereof. The anchor means 84 is preferably thicker than the washer 71, and is generally rectangular in shape to provide adequate material to support forces from the wire. It can be seen that the limb stiffening means 34, and thus the limb, is cantilevered from the body to support load thereon when the body is hanging. The portions 96 and 97 are free to rotate in the aligned openings and thus, if a force is applied to the stiffening means 34 as shown by an arrow 100 in FIGS. 3 and 9, i.e. from the back to the front, the limb stiffening means can rotate relatively freely a limited amount with respect to the tube in direction of the arrow. The relatively free initial rotation of the left limb in the direction of the arrow 100 is eventually limited when the end portion 98 contacts the tube 30, as shown in FIG. 9. Additional rotation beyond the initial rotation of the limb stiffening means 34 in direction of the arrow 100 is possible, but a gradually increasing resistance against the rotation is generated by the end portion 98 interfering with the tube. This interference results in a resistance due to torque generated in the wire, and is designed to warn the child against further bending of the limb to such an extent as to cause damage. Similarly, contact of the end portion 101 of the right limb stiffening means 33 resists further movement of the right limb in direction of an arrow 113.

If the limbs were rotated in a direction opposite to that of the arrow 100, i.e. from the front to the back, the end portions 99 and 102 would initially rotate freely and then eventually contact the tube 30. Thus, bending the limbs in the opposite direction similarly provides initial free rotation of the limbs, followed by a gradual increasing resistance to rotation after the initial free movement. The end portions 99 and 102 adjacent the front portions of the limbs are located closer to the tube 30 than the end portions 98 and 101 adjacent the back portion of the limbs. This provides less angular movement of the limbs towards the back than towards the front of the animal. The wire of the limb stiffening means has a sufficient stiffness to provide a relatively low counteracting force when the limbs are bent beyond the initial free stage, which force returns the limb stiffening means to their generally aligned position as shown in FIG. 3. Thus, initially the limbs can deflect resiliently relatively easily and additionally with increasing stiffness, and thus provide a rotation approximately about the axis 16 of the apparatus, and within the plane 85 (FIG. 2) disposed generally normally to the axis 16. However, the stiffness of the wire is such that the limbs are relatively resistant to deflection outside the plane 85, that is the limbs are relatively resistant to vertical deflection, particularly downwardly, so as to provide adequate support for garments hanging on the apparatus.

Thus, it can be seen that the proximal portions of the limb stiffening means provide a rotational means to permit relatively free initial rotational movement of the limbs relative to the body. The rotational means includes the aligned openings of the anchor means, and the inner portions of the wire passing therethrough. The proximal portions of the limbs also include restriction means to provide a gradually increasing resistance due to additional bending of the limbs beyond the initial bending. The restriction means include the short angle portions at the ends of the inner portions which interfere with the tubes after initial free rotation.

FIGS. 3–10

The latch means 56 as disclosed in FIG. 4 can be released by depressing the release portion 62 directly with the thumb or a finger and is located in the lower back of the animal. An alternative and additional means of depressing the release portion 62 can be provided by a trigger means 105 which is a length of stiff wire extending between outer bend portion 94 of the support means 34, and a corresponding outer bend portion 110 of the means 33. Outer ends of the trigger portion 105 are formed as elongated loops 106 and 107 which engage small circular loops 108 and 109 respectively in the side portion 92 and 103 adjacent the respective outer bend portions of the limb stiffening means. An intermediate portion 112 of the trigger portion 105 passes through aligned trigger openings 63 in the release portion 62. Unintentional release of the latch means 56 due to stiffness of the trigger portion 105 is overcome by force from the band 68 which holds the latch means engaged. Thus, bending or rotation of the stiffening means 33 and 34 in accordance with arrows 100 and 113 respectively moves the trigger means 105 inwardly per arrow 114 to overcome force from the band 68, which results in depression of the release portion 62, with a corresponding release of the support means. Rotation of the limbs in opposite directions does not release the support means. Thus, when the animal's head 12 is facing the child, that is the animal looking at the child, the trigger 105 can be actuated to release the support means when the limbs are pulled towards the child, but when the limbs are pushed away from the child, the support means is not released. This is considered to be a more normal movement that would be appropriate for a child.

Thus, a child can release the hook 21 by two means, firstly by directly pressing the release portion 62, or alternatively by bending the limbs 14 and 15 forwardly in direction of the arrows 113 and 100 respectively, so as to indirectly press the release portion. The first approach is a somewhat difficult because the release portion is a small item to locate within the padded body 13 and thus might be difficult for a young child, and thus a young child might prefer to bend the limbs. Thus, it can be seen that the trigger portion 105 serves as a trigger means for releasing the latch means by bending the limbs, and extends along the limbs with an intermediate portion 112 located generally adjacent the latch means to cooperate with the trigger means as required. It can also be seen that the trigger means and limbs have sufficient resiliency so that bending of the limbs towards each other and away from the latch means causes the trigger means to actuate the latch means to release the latch means to permit the support means to extend.

It is noted that the latch means 56, the limb stiffening means 33 and 34 and the trigger means 105 are fabricated from bent wire or simple sheet metal parts which do not require complex tooling or welding and can be simply assembled, thus reducing labour and tooling costs. As children can subject toys to considerable bending stresses, it was considered that welding of resilient materials would not be suitable as welds tend to fail when subjected to repeated bending. Thus, the present invention is manufactured and assembled by interconnecting metal parts by simple bends in the wire, or passing the wires through openings, and thus eliminates the need for welding or other complex manufacturing techniques. By merely bending the wire and hooking it to components for connections, life of the resulting product is considered to be longer than would otherwise be attainable using welding or other joining techniques.

Furthermore the mechanism is simple and should be relatively free from jamming due to interference with small moving parts and resilient padding material which surrounds small parts within the body.

ALTERNATIVES

While the support means is described as being resiliently extendible from the recess due to the spring, the latch means and trigger means can be eliminated for simplicity, and the support means would then be manually extendible from the recess.

Also, while the device has been described with an essentially all-metal internal structure 22, a suitable plastic could be substituted for the support means 36, the tube 30, the latch means 56, the washer 71 and the anchor means 84. In all instances, the structure is selected so that chances of stuffing from the interior of the animal interfering with the mechanism are minimal. For example, movement of the rocker arm to release the latch means is very small, for example between 1 and 2 millimeters, and this small amount of movement is unlikely to cause jamming with stuffing. Furthermore, the spring is fully enclosed within the tube, and is thus isolated from contamination with the stuffing. The rubber band has been selected as it mechanically simple and would require minimal maintenance, and is essentially free from problems of contamination with the stuffing material.

I claim:

1. A garment hanger and toy combination depicting a figure having a head and a body, said combination comprising:

(a) said head and said body disposed about a longitudinal axis, and a pair of limbs extending outwardly from the body generally transversely of the axis, the head having a top portion and a recess within the top portion disposed adjacent the axis, the limbs being cantilevered from the body to support a load thereon when the body is hanging, (b) support means for hanging the combination, the support means being axially extendable outwardly from the recess within the head, and axially retractable into the recess.

2. An apparatus as claimed in claim 1, further including:

(a) limiting means to limit movement of the support means relative to the recess to generally axial movement.

3. An apparatus as claimed in claim 1, further comprising:

(a) resilient means for applying an outwardly directed force to the support means, the resilient means cooperating with the support means, (b) latch means for latching the support means against the outwardly directed force, the latch means cooperating with the support means and the body.

4. An apparatus as claimed in claim 1, further comprising:

(a) guide means for guiding the movement of the support means axially of the body and the head.

5. An apparatus as claimed in claim 4, in which:

(a) the guide means comprises a tube, (b) the support means has inner and outer portion, the inner portion being mounted for axial movement within the tube, the outer portion having a hook portion or on eye portion.

6. An apparatus as claimed in claim 3, further comprising:

(a) a guide means for guiding the movement of the support means axially of the head and body portion, (b) the support means having a shoulder means, (c) the latch means being mounted for movement with respect to the body portion, the latch means having a release portion to release the latch means and an engaging portion which can be moved into engagement with the shoulder means so as to prevent outwards movement of the support means under the influence of the outwardly directed force.

7. An apparatus as claimed in claim 6, in which:

(a) the guide means comprises a tube, (b) the support means has inner and outer portions, the inner portion being mounted for axial movement within the tube, and the outer portion having a hook portion or an eye portion, (c) the tube has a side wall having a clearance opening therein adjacent the latch means, the opening being located to receive the engaging portion of the latch means, (d) the inner portion of the support means has a slot therein to provide the shoulder, the slot having a size to receive the engaging portion of the latch means.

8. An apparatus as claimed in claim 7, in which:

(a) the resilient means comprises a compression coil spring cooperating with the support means to apply the outwardly directed force thereto.

9. An apparatus as claimed in claim 3, in which:

(a) the limbs are resiliently hinged to the body for limited rotation with respect to the axis and generally within a plane disposed approximately normally to the axis, (b) the apparatus further includes trigger means for releasing the latch means, the trigger means cooperating with the latch means and the limbs so that bending by the said rotation the limbs activates the trigger means to release the latch means.

10. An apparatus as claimed in claim 1, in which:

(a) the body comprises a tube, (b) the limbs extend from the tube in opposite directions to each other, each limb having a distal portion and a proximal portion, the proximal portion being resiliently secured to the tube to permit the distal portions to deflect relative to the tube generally within a plane disposed approximately normally to the axis.

11. An apparatus as claimed in claim 10, in which:

(a) the proximal portion of each limb includes rotational means to permit relatively free initial rotational movement, of the limb relative to the body within the said plane, (b) the proximal portion of each limb further includes restriction means to provide a gradually increasing resistance due to additional bending of the limb beyond the initial rotational movement.

12. An apparatus as claimed in claim 10, in which:

(a) the limbs can deflect resiliently relatively easily to a provide a limited rotation generally about the axis of the apparatus, (b) the limbs are relatively resistant to deflection outside the said plane disposed generally normally to the axis, to provide adequate support for garments hanging on the apparatus.

13. An apparatus as claimed in claim 11, in which the rotational means includes:

(a) each limb having a respective limb stiffening means comprised of a loop of wire, the loop of wire having a pair of side portions interconnnected by an outer bend portion adjacent an outer end of the limb, so as to stiffen the distal portion of the limb, each side portion extending inwardly through an intermediate bend portion to respective inner portions extending generally parallel along the tube to cooperate with the tube, (b) anchor means located on the tube having openings to receive the end portions of the wire therein to permit relative rotation between the end portions and the anchor means, so as to permit limited rotation of the wire within the anchor means due to rotation of the limbs about the axis of the apparatus.

14. An apparatus as claimed in claim 13, in which the restriction means includes:

(a) the inner portions of the limb stiffening means having end portions which are initially spaced from the tube, and can rotate with the initial rotation of the inner portions with negligible restriction, the end portions being located sufficiently closely to the tube to interfere with the tube with additional bending of the limbs beyond the initial bending, to provide a gradually increasing resistance to further bending of the limbs.

15. An apparatus claimed in claim 6 in which:

(a) the latch means comprises a rocker arm which is mounted for rocking movement with respect to the guide means, (b) and the apparatus further comprises means to restrict the rocker arm against axial movement along the guide means.

16. An apparatus as claimed in claim 6 in which:

(a) the latch means comprises a rocker arm which is mounted for rocking movement with respect to the guide means, (b) and the apparatus further comprises means to restrict the rocker arm against lateral twisting with respect to the guide means.

17. An apparatus is claimed in claim 15 in which the means to restrict the rocker arm against axial movement along the guide means comprises:

(a) the rocker arm having an intermediate portion having a shallow V-shape to permit rocking with respect to the guide means, and a pair of oppositely located edge recesses to provide a waisted portion, (b) a pivot means mounted on the guide means and having a main recess to receive the waisted portion of the intermediate portion, the main recess having peripherally spaced shoulders defining ends of the recess, each shoulder being received in a respective edge recess.

18. An apparatus as claimed in claim 16 in which the means to restrict the rocker arm against lateral twisting with respect to the guide means comprises:

(a) the rocker arm having a release portion having a pair of generally parallel arms to define an end recess which has a size sufficient to receive the guide means therein.

* * * * *